US007649151B2

(12) United States Patent
Li

(10) Patent No.: US 7,649,151 B2
(45) Date of Patent: Jan. 19, 2010

(54) GEAR-TYPE KEY SWITCHES OF KEYBOARD DEVICE

(76) Inventor: Baisong Li, No. 21 Jinding Industrial Park, Jinfeng West Road Tangjia wan Town, Zhuhai, Guangdong Province (CN) 519085

( * ) Notice: Subject to any disclaimer, the term of this patent is extended or adjusted under 35 U.S.C. 154(b) by 0 days.

(21) Appl. No.: 10/589,600

(22) PCT Filed: Jan. 28, 2005

(86) PCT No.: PCT/CN2005/000124

§ 371 (c)(1),
(2), (4) Date: May 19, 2008

(87) PCT Pub. No.: WO2005/121934

PCT Pub. Date: Dec. 22, 2005

(65) Prior Publication Data

US 2008/0223704 A1 Sep. 18, 2008

(30) Foreign Application Priority Data

Jun. 12, 2004 (CN) ..... 2004 2 0047091 U

(51) Int. Cl.
*H01H 13/70* (2006.01)

(52) U.S. Cl. ..... 200/344; 200/345

(58) Field of Classification Search ..... 200/344
See application file for complete search history.

(56) References Cited

U.S. PATENT DOCUMENTS 5,813,521 A 9/1998 Koike et al. ..... 200/344
6,060,676 A * 5/2000 Pan ..... 200/344
6,371,671 B1 * 4/2002 Sato et al. ..... 400/495
6,586,695 B2 * 7/2003 Sato et al. ..... 200/344
7,138,587 B2 * 11/2006 Nishino et al. ..... 200/5 A

FOREIGN PATENT DOCUMENTS

| | | |
|---|---|---|
| CN | 97221445.3 | 3/1999 |
| CN | 2368074 Y | 3/2000 |
| CN | 99208030.4 | 5/2000 |
| CN | 2615846 Y | 5/2004 |
| JP | 2002298685 A | 11/2002 |

* cited by examiner

*Primary Examiner*—Michael A Friedhofer
*Assistant Examiner*—Lheiren Mae A Anglo

(57) ABSTRACT

A gear-type key switch of a keyboard device of the present invention includes a key top, a holder member, four gears, a spring member, a film circuit board and a supporting plate. The spring member and the holder member are located above the supporting plate and below the key top. The film circuit board is located between the supporting plate and the spring member. The holder member forms four pairs of shafts and the four gears are respectively rotatably assembled to the four pairs of shafts. The key top forms at least four rack supporting members on a bottom thereof. The rack supporting members are respectively parallel to the four gears and engage with the four gears to provide the upward and downward movement of the key top. The gear-type key switch of a keyboard device is simple in structure, with low friction force and decreased height. In addition, the gears can be assembled in mass via special assistant tools, and the keyboard device is also featured in perfect pressing handle, super-thin and easy assembly.

18 Claims, 4 Drawing Sheets

GEAR-TYPE KEY SWITCHES OF KEYBOARD DEVICE

BACKGROUND OF THE INVENTION

1. Field of the Invention

The present invention generally relates to a key switch of a keyboard device, and more particularly to a key switch of a keyboard device for a computer.

2. Description of Related Art

Conventional structure of a key switch is of hole structure which is skilled in the art. However, such structure of a key switch creates relatively large friction force which is not glad to be seen by user. In addition, hole-structure restricts the decrease of height of the whole keyboard device. To resolve such problems caused by the conventional key switch, people apply themselves to develop new structures of key switch.

Forficiform structure is one of the new types of the keyboard device developed by people to resolve problems stated above, such as China Patent No. 99208030.4 and China Patent No. 97221445.3 etc. However, such forficiform structure is relatively complex in structure and is not suitable for mass production. Thus, new design is highly desired to be developed to resolve the problems stressed above.

BRIEF SUMMARY OF THE INVENTION

Accordingly, an object of the present invention is to provide a gear-type key switch of a keyboard device with simple structure, low friction force when moving upwardly and downwardly, and decreased height. The gears of the gear-type key switch of the keyboard device can be assembled in mass with aid of special assistant tools.

In order to achieve the above-mentioned object, a gear-type key switch of a keyboard device in accordance with the present invention comprises a key top, a holder member, four gears, a spring member, a film circuit board and a supporting plate. The spring member and the holder member are located above the supporting plate and below the key top. The film circuit board is located between the supporting plate and the spring member. The holder member forms four pairs of shafts and the four gears are respectively rotatably assembled to the four pairs of shafts to form quadrangle shape. The key top forms at least four rack supporting members extending downwardly from a bottom surface thereof which are respectively parallel to corresponding gears and engage with corresponding gears to provide the upward and downward movement for the key top. When the key top is pressed downwardly, the four rack supporting members of the key top respectively engage with the four gears and form a balance, thus, the key top is capable of moving downwardly and upwardly along a vertical direction and assures perfect pressing handle.

Middle area of each rack supporting member of the key top can be cut to form two side racks. This decreases the contacting area between the racks and the gear and thus, reducing friction force therebetween while keeping the balance when pressing of the key top at the same time.

Each rack supporting member is preferably formed with a restrictive barb at a bottom edge thereof to restrict excessive upward movement of the key top under the elastic return force of the spring member.

A gear-type key switch of a keyboard device in accordance with the present invention comprises a key top, a holder member, three gears, a spring member, a film circuit board and a supporting plate. The spring member and the holder member are located above the supporting plate and below the key top. The film circuit board is located between the supporting plate and the spring member. The holder member forms three pairs of shafts and the three gears are respectively rotatably assembled to the three pairs of shafts to form triangular shape. The key top forms at least three rack supporting members extending downwardly from a bottom surface thereof which are respectively parallel to corresponding gears and engage with corresponding gears to provide the upward and downward movement for the key top. When the key top is pressed downwardly, the three rack supporting members of the key top respectively engage with the three gears and form a balance, thus, the key top is capable of moving downwardly and upwardly along a vertical direction and assures perfect pressing handle.

Middle area of each rack supporting member of the key top can be cut to form two side racks. This decreases the contacting area between the racks and the gear and thus, reducing friction force therebetween while keeping the balance when pressing of the key top at the same time.

Each rack supporting member is preferably formed with a restrictive barb at a bottom edge thereof to restrict excessive upward movement of the key top under the elastic return force of the spring member.

Other objects, advantages and novel features of the invention will become more apparent from the following detailed description of the present embodiment when taken in conjunction with the accompanying drawings.

DETAILED DESCRIPTION OF THE INVENTION

Figure 1:
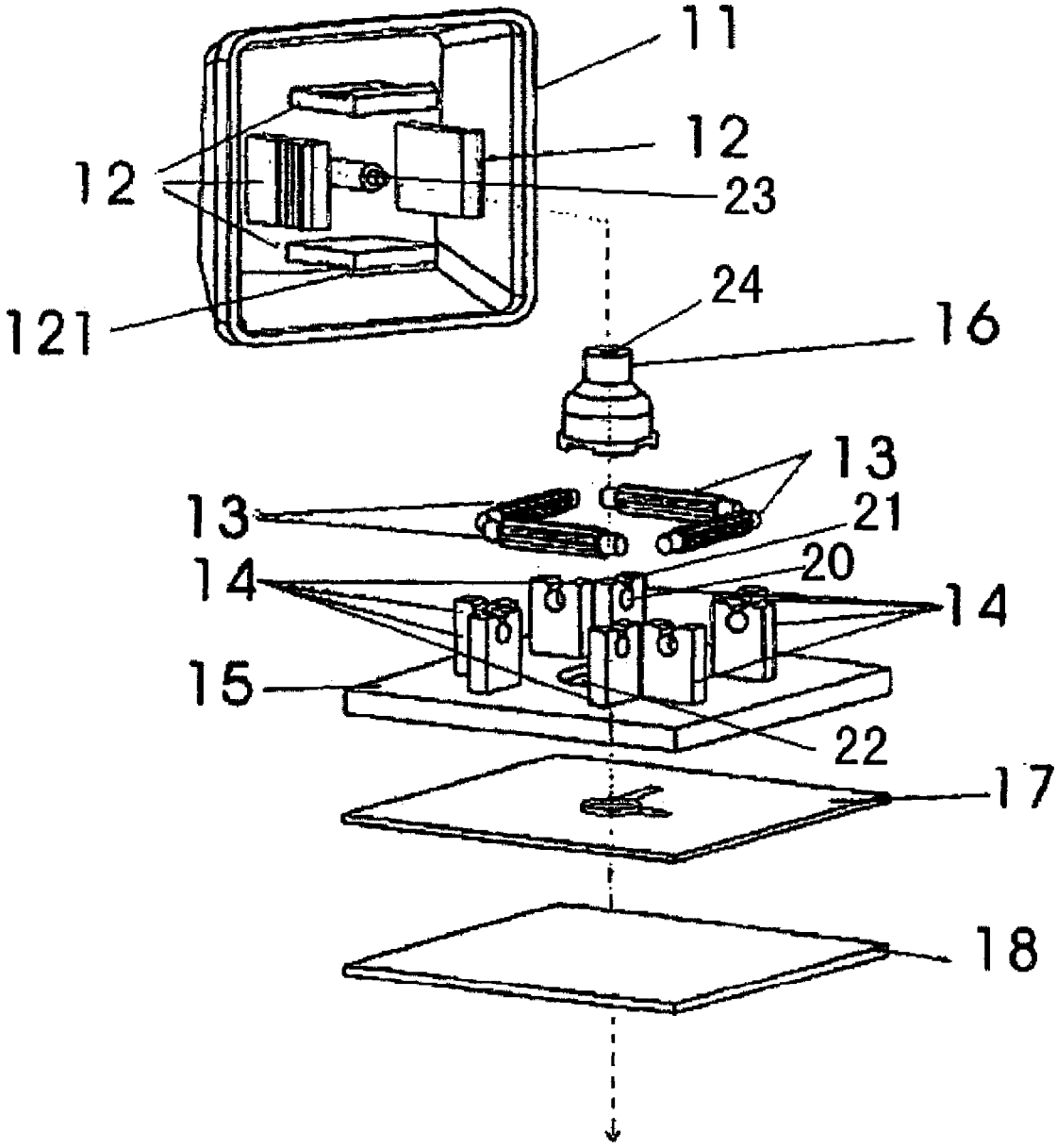
FIG. 1 is an exploded, perspective view of a gear-type key switch of a keyboard device in accordance with the first embodiment of the present invention which employs four gears.

Reference will now be made to the drawing figures to describe the present invention in detail.

Figure 2:
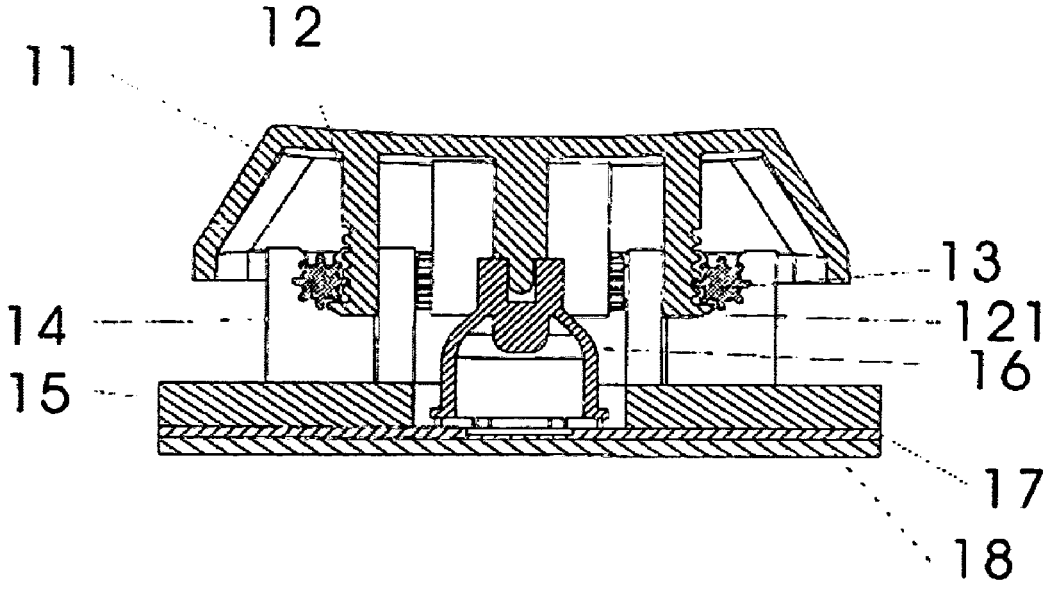
FIG. 2 is a cross-section view of the gear-type key switch of a keyboard device of the present invention.

Referring to FIGS. 1-2, a gear-type key switch of a keyboard device of the first embodiment of the present invention comprises a key top 11, a holder member 15, four gears 13, a spring member 16 comprising a dome portion and an edge portion formed at a bottom of the dome portion, a film circuit board 17 and a supporting plate 18. The spring member 16 and the holder member 15 are located above the supporting plate 18 and under the key top 11. The holder member 15 defines a circular through hole 22, and the edge portion of the spring member 16 protrudes through the circular through hole 22 of the holder member 15 to electrically connect with the film circuit board 17 for signal transmission. The film circuit board 17 is located between the supporting plate 18 and the spring member 16. Four pairs of shafts 14 are disposed on the holder member 15 around the circular through hole 22. Each gear 13 comprises a body portion forming a plurality of gear teeth and two opposite ends with diameter smaller than that of the body portion. The two shafts 14 of each pair are arranged face to face with a predetermined distance corresponding to the opposite ends of each gear 13 for rotatably supporting the gear 13. Each shaft 14 defines a gear-receiving hole 20 with a small-size opening 21 communicating with the gear-receiving hole 20 and the top edge thereof. The opposite ends of each gear 13 are correspondingly pressed through the openings 21 of the pair of the shafts 14 to be received in the gear-receiving holes 20 and are capable of rotating in the gear-receiving holes 20. Thus the four gears 13 assembled to the shafts 14 form a quadrangle shape. In addition, adjacent two shafts 14 of different pairs are arranged to form an angle about 90 degrees therebetween.

At least four rack supporting members 12 extend downwardly from a bottom surface of the key top 11 corresponding to the gears 13. Each rack supporting member 12 forms a plurality of rack teeth on outer surface thereof to engage with the gear teeth of corresponding gear 13, thus, forming gear-type structure of the key switch which is capable of moving upwardly and downwardly. A post 23 is formed in a center of the area circumscribed by the four rack supporting members 12 of the key top 11 to insert into a hole 24 defined in the spring member 16 for position the key top 11 to the spring member 16. When the key top 11 is pressed downwardly, the four rack supporting members 12 of the key top 11 respectively engage with the gear teeth of the four gears 13 and form a balance. Therefore, the key top 11 is capable of moving upwardly and downwardly along a substantially vertical direction and achieves perfect pressing handle. Each rack supporting member 12 forms a restrictive barb 121 extending outwardly beyond the outer surface thereof for restricting excessive upward movement of the key top 11 actuated by the elastic return force of the spring member 16.

Figure 3:
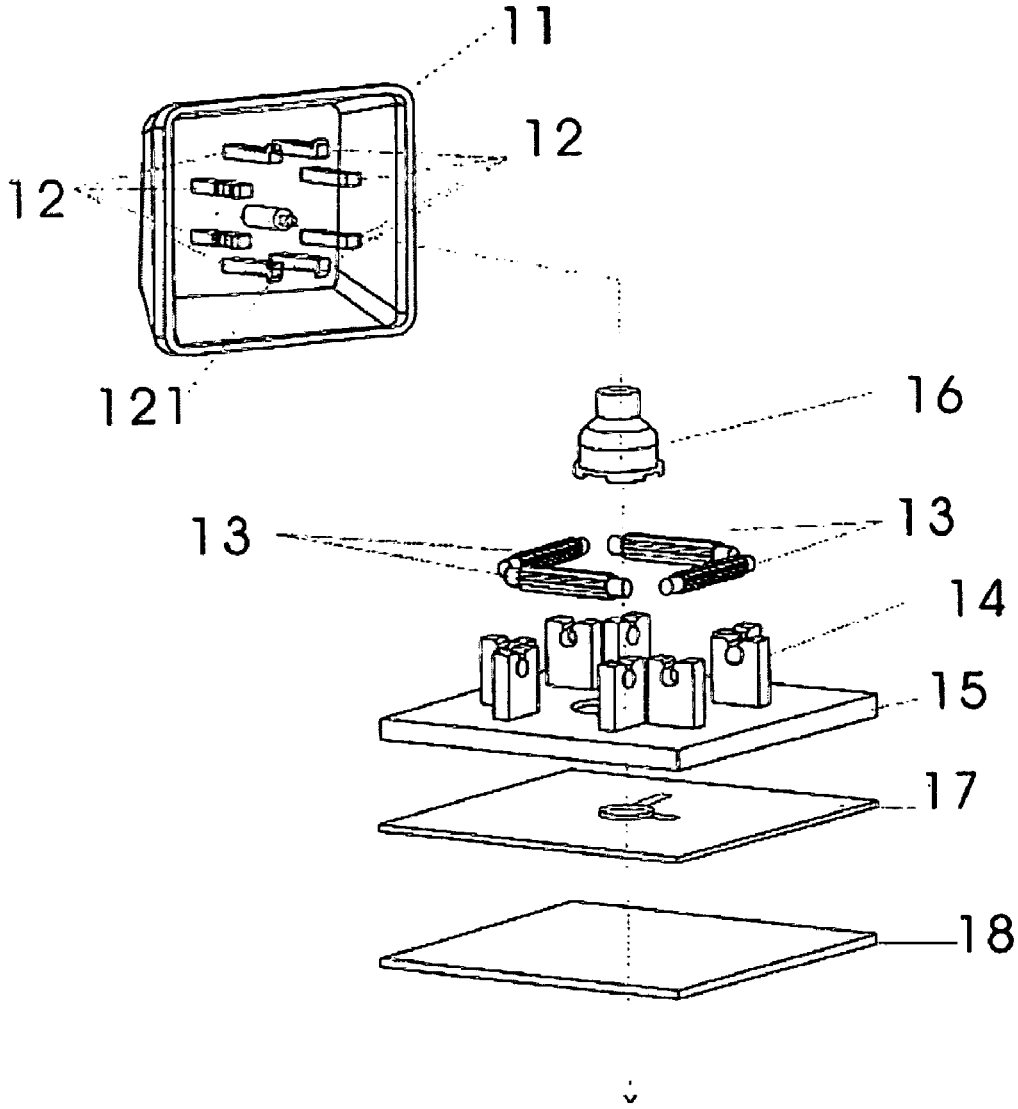
FIG. 3 is a view illustrating rack supporting members formed on a bottom of a key top are partially cutoff to form a pair of racks at opposite sides.

Referring to FIG. 3, to decrease the friction force between the gears 13 and the key top 11 further, it is preferable to cut middle area of each rack supporting member 12, as a result, dividing the rack supporting member 12 into two racks at opposite sides. Thus, the contacting area between the gears 13 and key top 11 is decreased and the friction force is also reduced.

Figure 4:
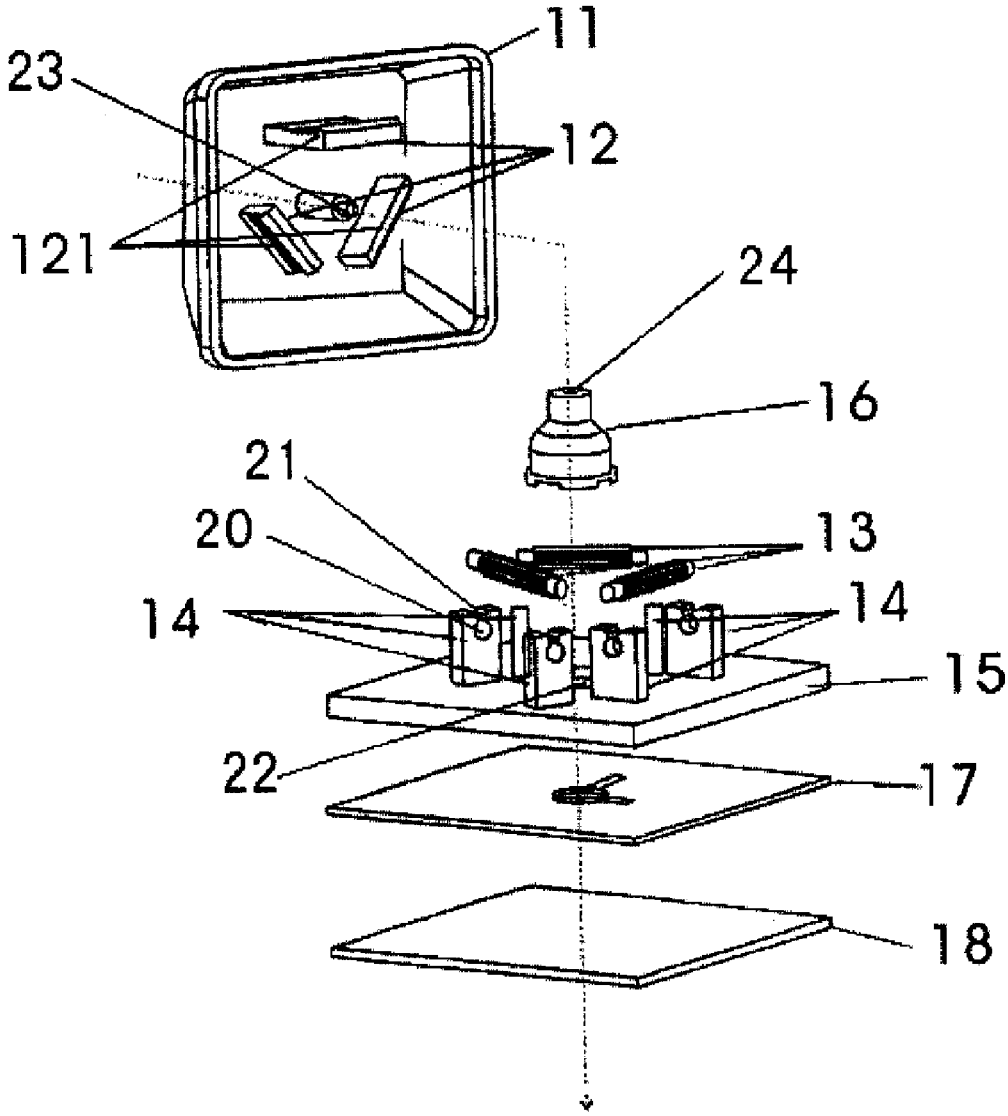
FIG. 4 is an exploded, perspective view of a gear-type key switch of a keyboard device in accordance with the second embodiment of the present invention which employs three gears.

Referring to FIG. 4, a gear-type key switch of a keyboard device of the second embodiment of the present invention comprises a key top 11, a holder member 15, three gears 13, a spring member 16 comprising a dome portion and an edge portion formed at a bottom base of the dome portion, a film circuit board 17 and a supporting plate 18. The spring member 16 and the holder member 15 are located above the supporting plate 18 and under the key top 11. The holder member 15 defines a circular through hole 22 and the edge portion of the spring member 16 protrudes through the circular trough hole 22 of the holder member 15 to electrically connect with the film circuit board 17 for signal transmission. The film circuit board 17 is located between the supporting plate 18 and the spring member 16. Three pairs of shafts 14 are disposed on the holder member 15 around the circular through hole 22. Each gear 13 comprises a body portion forming a plurality of gear teeth and two opposite ends with diameter smaller than that of the body portion. The two shafts 14 of each pair are arranged face to face with a predetermined distance corresponding to the opposite ends of each gear 13 for rotatably supporting the gear 13. Each shaft 14 defines a gear-receiving hole 20 with a small-size opening 21 communicating with the gear-receiving hole 20 and the top edge thereof. The opposite ends of each gear 13 are correspondingly pressed through the openings 21 of the pair of the shafts 14 into the gear-receiving holes 20 and are capable of rotating in the gear-receiving holes 20. Thus, the three gears 13 assembled to the shafts 14 form a triangular shape. In addition, adjacent two shafts 14 of different pairs are arranged to form an angle about 120 degrees therebetween.

At least three rack supporting members 12 extend downwardly from the bottom surface of the key top 11 corresponding to the gears 13. Each rack supporting member 12 forms a plurality of rack teeth on outer surface thereof to engage with the gear teeth of corresponding gear 13, thus, forming gear-type structure of the key switch which is capable of moving upwardly and downwardly. A post 23 is formed in a middle of the area circumscribed by the three rack supporting members 12 of the key top 11 to insert into a hole 24 defined in the spring member 16 for position the key top 11 to the spring member 16. When the key top 11 is pressed downwardly, the three rack supporting members 12 of the key top 11 respectively engage with the gear teeth of the three gears 13 and form a balance. Therefore, the key top 11 is capable of moving upwardly and downwardly along a substantially vertical direction and achieves perfect pressing handle. Each rack supporting member 12 forms a restrictive barb 121 extending beyond the outer surface thereof for restricting excessive upward movement of the key top 11 actuated by the elastic return force of the spring member 16.

To decrease the friction force between the gears 13 and the key top 11 further, it is also preferable to cut middle area of each rack supporting member 12, as a result, dividing the rack supporting member 12 into two racks at opposite sides. Thus, the contacting area between the gears 13 and key top 11 is decreased and the friction force is also reduced.

By means of the engagement between the gear teeth gears 13 and the rack teeth of the rack supporting members 12, the whole assembly of the key top 11 becomes easy with low friction force, perfect pressing handle and decreased height. Thus, the keyboard device achieves the super-thin feature which is popular currently.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A gear-type key switch of a keyboard device, comprising:

a key top;

a holder member;

four gears;

a spring member for providing elastic return force for the key top;

a film circuit board; and a supporting plate; and wherein the spring member and the holder member are located above the supporting plate and below the key top, the film circuit board is located between the supporting plate and the spring member; and wherein the holder member have four pairs of shafts disposed thereon, said four gears are respectively rotatably assembled to the four pairs of shafts, the key top forms at least four rack supporting members on a bottom thereof; wherein the at least four rack supporting members are respectively parallel to corresponding gears and engage with corresponding gears to provide the upward and downward movement for the key switch.

2. The gear-type key switch of the keyboard device as claimed in claim 1, wherein the four gears form a quadrangle shape.

3. The gear-type key switch of the keyboard device as claimed in claim 1, wherein each rack supporting member of the key top forms a restrictive barb on a bottom edge thereof to restrict excessive upward movement of the key top.

4. The gear-type key switch of the keyboard device as claimed in claim 1, wherein each rack supporting member is capable of being divided into at least two racks.

5. The gear-type key switch of the keyboard device as claimed in claim 1, wherein each pair of shafts are arranged face to face corresponding to the length of corresponding gear.

6. The gear-type key switch of the keyboard device as claimed in claim 5, wherein each shaft defines a gear-receiving hole and an opening with dimension smaller than the gear-receiving hole, and wherein each opposite end of the gear is pressed through the opening into the gear-receiving hole.

7. The gear-type key switch of the keyboard device as claimed in claim 1, wherein the adjacent two shafts of different pairs form an angle about 90 degrees therebetween.

8. The gear-type key switch of the keyboard device as claimed in claim 1, wherein the holder member defines a through hole therein, and wherein the spring member partially protrudes through the through hole of the holder member to electrically connect with the film circuit board.

9. The gear-type key switch of the keyboard device as claimed in claim 1, wherein the key top forms a post located in a center of an area circumscribed by the four rack supporting members, and wherein the spring member defines a hole to permit the post of the key top to insert for providing the engagement between the key top and the spring member.

10. A gear-type key switch of a keyboard device, comprising:

a key top;

a holder member;

three gears;

a spring member for providing elastic return force to the key top;

a film circuit board; and a supporting plate; and wherein the spring member and the holder member are above the supporting plate and below the key top, the film circuit board is located between the supporting pinte and the spring member; and wherein the holder member have three pairs of shafts disposed thereon, said three gears are respectively rotatably assembled to the three pairs of shafts, the key top forms at least three rack supporting members on a bottom thereof; wherein the at least three rack supporting members are respectively parallel to corresponding gears and engage with corresponding gears to provide the upward and downward movement for the key top.

11. The gear-type key switch of the keyboard device as claimed in claim 10, wherein the three gears form a triangular shape.

12. The gear-type key switch of the keyboard device as claimed in claim 10, wherein each rack supporting member of the key top forms a restrictive barb on a bottom edge thereof to restrict excessive upward movement of the key top.

13. The gear-type key switch of the keyboard device as claimed in claim 10, wherein each rack supporting member is capable of being divided into at least two racks.

14. The gear-type key switch of the keyboard device as claimed in claim 10, wherein each pair of shafts are arranged face to face corresponding to the length of corresponding gear.

15. The gear-type key switch of the keyboard device as claimed in claim 13, wherein each shaft defines a gear-receiving hole and an opening with dimension smaller than the gear-receiving hole, and wherein each opposite end of the gear is pressed through the opening into the gear-receiving hole.

16. The gear-type key switch of the keyboard device as claimed in claim 10, wherein the adjacent two shafts of different pairs form an angle about 120 degrees therebetween.

17. The gear-type key switch of the keyboard device as claimed in claim 10, wherein the holder member defines a through hole therein, and wherein the spring member partially protrudes through the through hole to electrically connect with the film circuit board.

18. The gear-type key switch of the keyboard device as claimed in claim 10, the key top forms a post located in a center of an area circumscribed by the three rack supporting members, and wherein the spring member defines a hole to permit the post of the key top to insert for providing the engagement between the key top and the spring member.

* * * * *